362-112 SR
12/16/80 XR 4,239,129

United States Patent [19]

Esposito

[11] 4,239,129

[45] Dec. 16, 1980

[54] WATER PISTOL AND/OR FLASHLIGHT STRUCTURE

[76] Inventor: Gary F. Esposito, 5862 Lexington Ave., Portage, Ind. 46368

[21] Appl. No.: 964,680

[22] Filed: Nov. 29, 1978

[51] Int. Cl.[3] ..... F41B 9/00

[52] U.S. Cl. ..... 222/79; 362/112

[58] Field of Search ..... 222/79, 113; 273/84 R; 362/112, 109, 113

[56] References Cited

U.S. PATENT DOCUMENTS

| | | | |
|---|---|---|---|
| 2,536,484 | 1/1951 | Avery | 362/112 |
| 2,629,516 | 2/1953 | Badham | 222/79 |
| 2,648,159 | 8/1953 | Rotfeld | 362/112 X |
| 2,660,000 | 11/1953 | Strayer | 362/112 X |
| 3,240,924 | 3/1966 | Darby | 362/112 |
| 3,365,838 | 1/1968 | Butler | 222/79 X |
| 3,578,789 | 5/1971 | Ferri | 222/79 |

*Primary Examiner*—Stanley H. Tollberg
*Attorney, Agent, or Firm*—Charles S. Penfold

[57] ABSTRACT

The subject invention involves a toy water pistol which embodies improvements with respect to a reciprocal pump therefor for building up pressure against a liquid for ejecting a stream thereof forwardly through a nozzle an appreciable distance; valve means for controlling the flow of the liquid; a source of electricity; light responsive means and lamps therefor for constituting means for illuminating the stream; a buzzer and a switch for controlling the operation of the lamp and buzzer; and a trigger for simultaneously operating the valve means and switch.

35 Claims, 12 Drawing Figures

WATER PISTOL AND/OR FLASHLIGHT STRUCTURE

BACKGROUND OF THE INVENTION

Children of all ages, especially boys, through the years have exhibited a fascination for water, lights and noise and the subject invention deals with these factors embodied in a toy simulating a pistol.

An appreciable number of U.S. patents have issued which are directed to water pistols but none appear to disclose a unique assembly of components which can be utilized to simultaneously produce a jet or stream of water, means for illuminating the stream and a noise, or if so desired, one which can be operated without employing the noise and the stream illuminating means. A reciprocable pump is employed to obtain sufficient pressure whereby the pistol can eject a stream an appreciable distance in the neighborhood of thirty feet and this stream can be illuminated to more or less simulate a lazer beam.

OBJECTIVES OF THE INVENTION

In view of the foregoing, and more particularly, one of the important objects of the subject invention is to provide a toy which comprises wall structure forming an elongated barrel having appreciable cross-sectional dimensions and a chamber for containing a supply of water and an offset forming a hollow handle for housing or supporting a source of electricity, such as one or more batteries, valve means, a switch, and a trigger for controlling the operation of the valve means and the switch.

A significant objective of the invention is to provide a unique organization of components which offers a setup whereby certain of the components or subassemblies of the toy or structure can be selectively operated and/or installed. For example, the pistol may be utilized solely for expelling or projecting a stream of water, in which event, the electrical system is rendered inoperative, or conversely the electrical system may be rendered operative to the exclusion of the water system.

A particular object of the invention is to provide the barrel structure of the toy or device with subassemblies at its front and rear extremities, each subassembly preferably including a colored lens or light responsive means, a lamp backed by a reflector, and a support or mounting therefor the subassembly at the front extremity serving to provide a forward beam of colored light throughout substantially the full length of the stream of water ejected, which as stated above may be projected an appreciable distance in the neighborhood of thirty feet.

A specific but very important object is to provide the barrel with a pumping system which comprises an elongated tank, an elongated cylinder disposed axially in the tank and a piston or plunger mounted in the cylinder for manual operation to force air into the tank for expelling the water therefrom and out through a nozzle at the front extremity. The cylinder is provided with a conventional check valve. The tank is provided with a refill protuberance extending through an upper wall portion of the barrel and certain of the subassemblies, above referred to, are respectively disposed adjacent the extremities of the tank and are designed to conform to shapes of the barrel structure.

Another object of the invention is to provide the rear extremity of the barrel with a buzzer or noise producing device and the hollow handle with a lower space or compartment for housing one or more batteries, as generally referred to above, an upper area for accommodating the valve means and switch, and a support for the trigger.

A particularly significant objective is to provide a unique control assembly or system for simultaneously controlling the operation of the valve means, switch, and noise producing unit.

A specific object is to provide an improved nozzle which offers an infinite range of manual adjustments, within practicable limits, for directing a stream of liquid where desired.

A further specific object is to provide means whereby the piston rod of the pump may be detachably locked or held in a forward inoperative position for safety purposes.

Other objectives reside in providing a water pistol which is safe for use by everyone, durable, readily manipulable, offers advantages with respect to assembly and disassembly, and is efficient in operation.

Additional objects and advantages of the invention will become apparent after the description hereinafter set forth is considered in conjunction with the drawings annexed hereto.

DRAWINGS

DESCRIPTION

Figure 5:
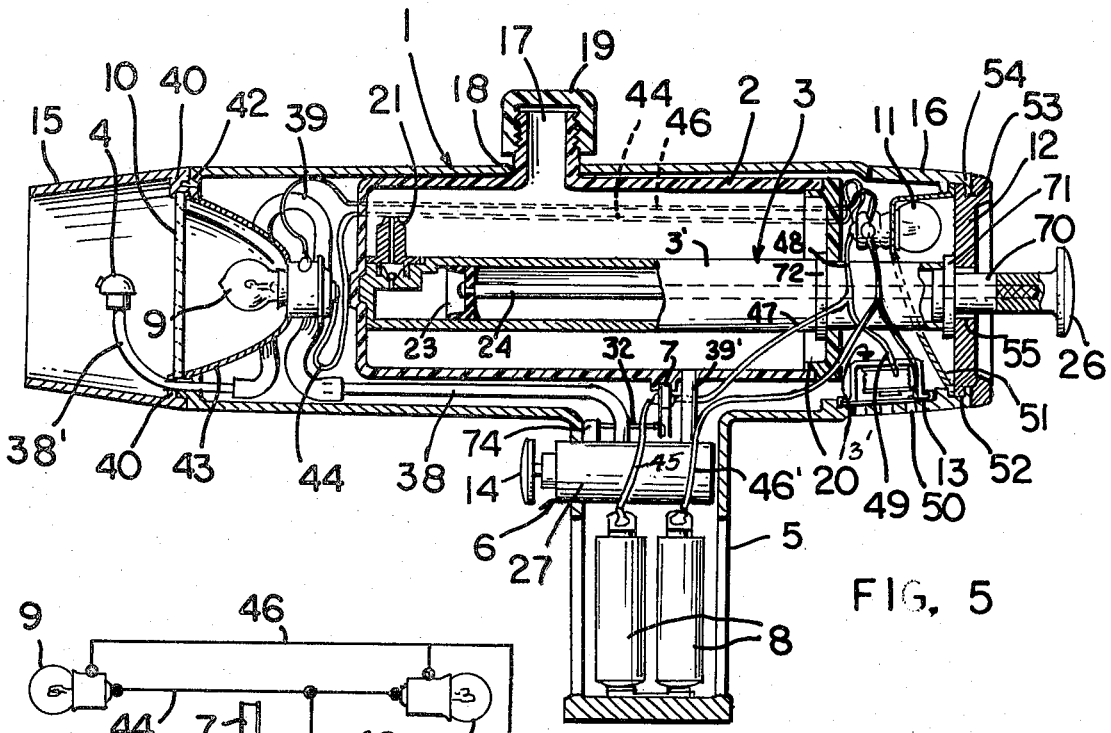
FIG. 5 is a horizontal section depicting the operative relationship of the various subassemblies or components of the toy.

Referring to the drawings, and particulary to FIG. 5, the device or toy includes, among other things, wall structure forming an elongated barrel generally designated 1 and a chamber or tank 2 for liquid within the confines of the barrel, a pump generally designated 3 in the tank, for applying pressure to the liquid, for ejecting a jet stream of water through a nozzle 4 and a hollow handle 5 disposed intermediate the extremities of the barrel for containing a valve means generally designated 6, a switch 7 carried by the tank and a source of electricity preferably comprising a pair of batteries 8. The toy or device also includes a lamp 9 and a light responsive means 10 located at the front extremity of the barrel, a lamp 11, light responsive means or lens 12 and a buzzer 13 at its rear extremity and a trigger 14 for controlling the operation of the valve means 6 and the switch 7.

The barrel 1 is preferably constructed of a durable molded plastic material having variable cross-sectional dimensions so that it is generally in the form of a tapered cylinder and its front and rear extremities are respectively provided with subassemblies having fittings or end supports or mountings 15 and 16, also of plastic, which are preferably press fitted or otherwise telescopically and detachably secured in or to the extremities of the barrel for supporting the lamps, light responsive means and buzzer.

Figure 2:
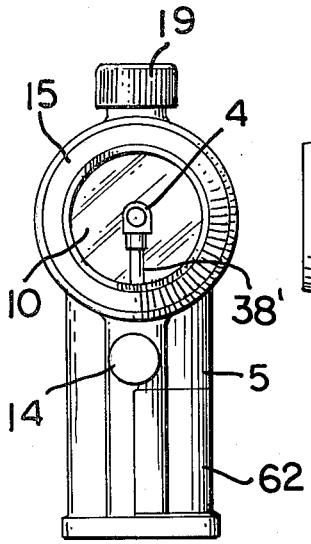
FIG. 2 is a front elevational view of the toy.
Figure 1:
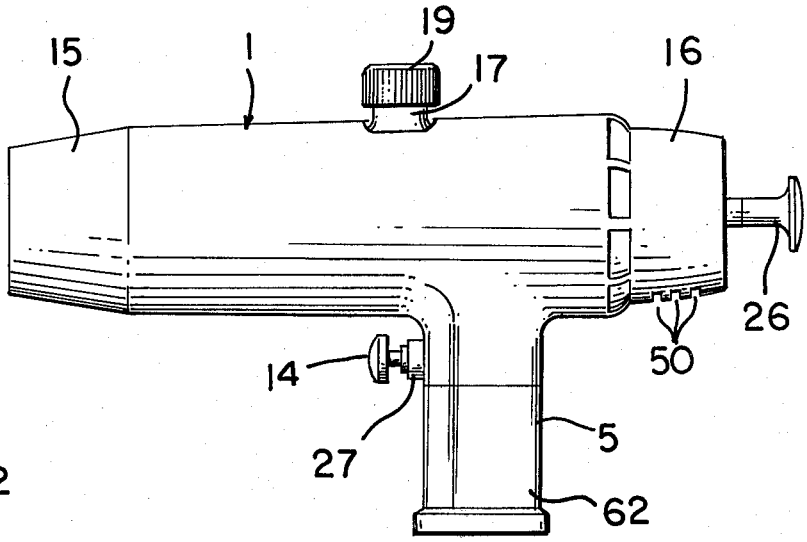
FIG. 1 is a side view of the toy embodying the subject invention.
Figure 3:
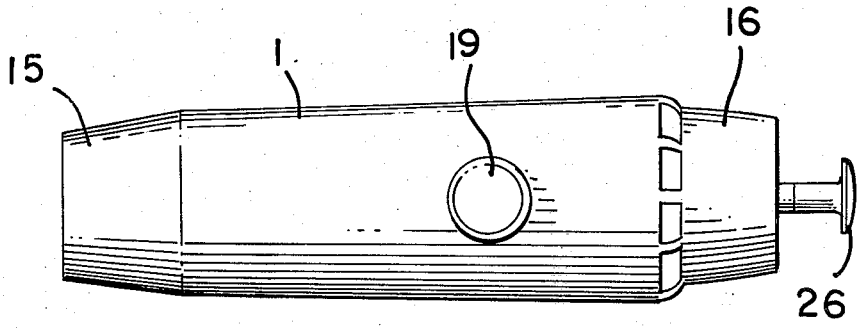
FIG. 3 is a top view of the toy.
Figure 4:
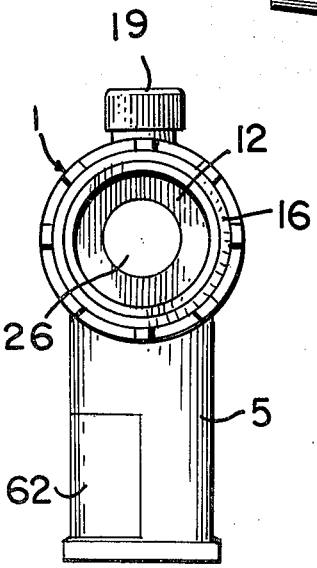
FIG. 4 is a rear elevational view of the toy.
Figure 8:
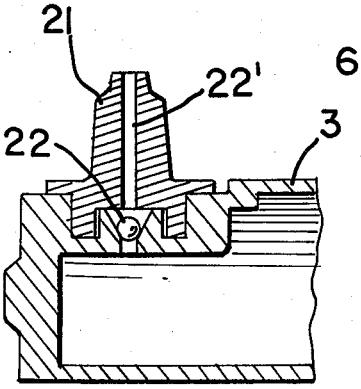
FIG. 8 is an enlarged sectional view of a check valve utilized in the pumping system.

The tank 2 located in the barrel and its associated parts will now be described. This tank is preferably in the form of an elongated cylinder and it has a tubular externally threaded protuberance or offset 17 which extends upwardly through an opening 18 provided therefor in the barrel and a cap 19 is threadedly connected to the offset for sealing the tank after it is filled with a liquid such as water. The tank may include a press fitted rear end wall 20 having an opening therein through which the rear end of a cylinder 3' of the pump 3 extends into the mounting 16 and the front end of this cylinder is provided with a conventional check valve assembly 21. This assembly shown in FIG. 8 includes a ball 22 and a vent 22'. The pump includes a piston 23 having a rod 24 which extends through a fixed tubular bearing 70 of the cylinder and through the light responsive means 12 and carries a handle 26 whereby to facilitate reciprocation of the rod and piston to force air into the tank through the check valve assembly 21 and build up pressure sufficient to expel water therefrom and to and through the nozzle 4 an appreciable distance of approximately thirty feet as stated above.

The front end of the cylinder 3' is provided with a projection which fits into a recess provided therefor in the front end wall of the tank 2 as clearly shown in FIG. 5. The rear end of the cylinder is closed by the tubular bearing 70 which has a radial flange 71 engaging an inner surface of the lens 12 and a cylindrical portion which extends through an opening in this lens. The cylinder is also provided with an annular bead 72 which engages the end wall 20 of the tank. This structure serves to support the cylinder in a practical way.

Figure 7:
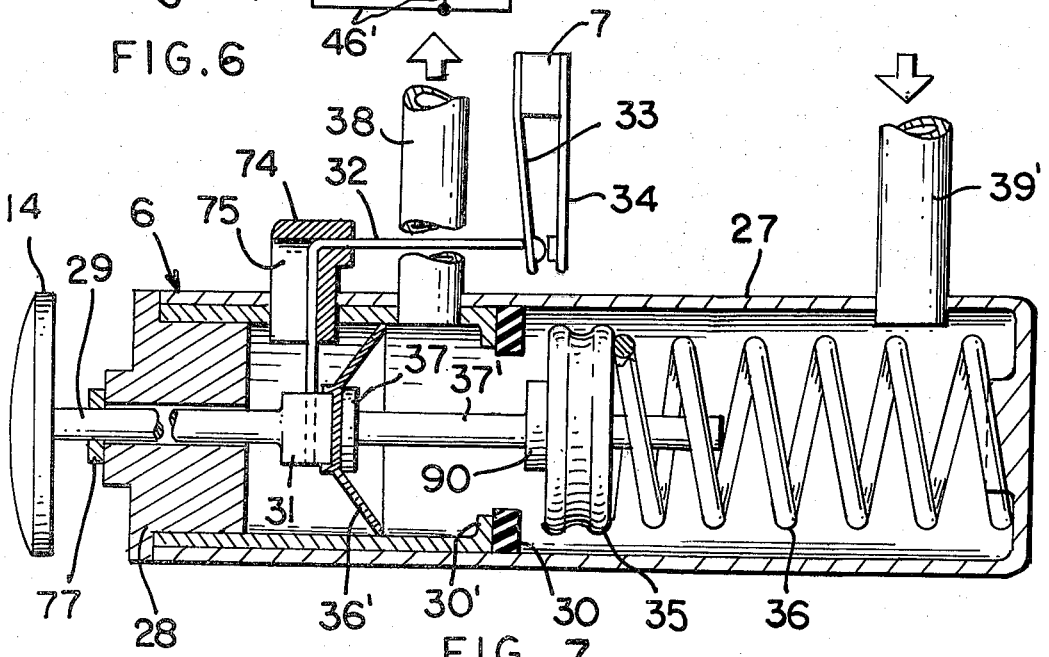
FIG. 7 is an enlarged horizontal section of a valve assembly and switch structure.

The valve means generally designated 6 constitutes a subassembly and is preferably housed in and fixedly secured in the hollow handle 5. It may be designed and constructed in various ways but as best shown in FIG. 7 it preferably includes a relatively small cylindrical casing 27 in which is disposed a front tubular end bearing 28, a shaft 29 slidable therein and which constitutes a component of the trigger 14. The casing is provided with an internal resilient ring, gasket or washer 30 which engages an end of an internal fixed tubular sleeve or abutment 30' which carries the bearing 28. The shaft has an enlargement 31 provided with an angled member 32 having an offset finger for causing a resiliently flexible contact 33 to engage an adjacent fixed contact 34 of the switch 7. The lower portion of the member 32 is preferably non-circular in cross-section and fits into the enlargement 31 so as to fixedly secure the member to the shaft. An angular guide or element 74 has a fixed portion extending into the casing 27 and sleeve 30' and guiding surfaces 75 for the member 32. A second shaft 37' is provided with a resilient annular valve 35 which is normally held against the gasket 30 by a helical spring 36 which encircles this shaft and is interposed between the valve 35 and an end wall of the casing 27. The shaft 29 carries a resilient frusto-conical seal 36' which slidably engages the internal cylindrical surface of the sleeve 30' whereby to prevent back flow of water outwardly through the bearing 28 and through the member 74. The seal 36' is firmly held against the enlargement 31 by a member 37 secured to the second shaft 37' by the spring 36. Otherwise expressed, the seal 36' is clamped between the enlargement 31 of shaft 29 and member 37 of shaft 37'. The shaft 29 is provided with a stop 77 for limiting and positioning the seal 36' with respect to an outlet conduit section 38 of a conduit means. The shaft 37' is provided with a stop 90 engaging the valve 35 for an obvious purpose.

Conduit means are provided for communicatively connecting the tank 2, valve means 6 and nozzle 4 and includes a conduit 39' connecting the tank and valve means and conduit sections 38 and 38' connecting the nozzle with the valve means. An inverted tube or conduit 39 serves to detachably connect the sections 38 and 38' together. These sections and the tube or conduit 39 are preferably made of relatively rigid plastic tubes so that they retain the shapes to which they have been formed. The operation of the valve means is relatively simple. When the valve 35 is in engagement with the washer 30 water is prevented from flowing through the conduit means 38, 38' and 39 to the nozzle but when the trigger 14 is slidably pressed rear-wardly against the bias of the spring 36 the valve 35 will disengage the washer 30 and allow the water to enter the casing 27 through the conduit 39'. More explicitly, when the valve is held against the fixed gasket 30 by the biasing action of the spring, water under pressure in the tank will only flow into the casing 27 through the conduit 39' but when the trigger is pressed rearwardly to cause a stop 77 on the shaft 29 to engage the bearing 28, the valve 35 will disengage the washer or seat 30 and allow water to flow from the tank 2 into the casing through the conduit 39' and thence through the conduit means 38, 39 and 38' to the nozzle 4 and simultaneously cause the member 32 to actuate the switch 7 to illuminate the lamps 9 and 11 and operate the buzzer 13 as alluded to above.

Figure 10:
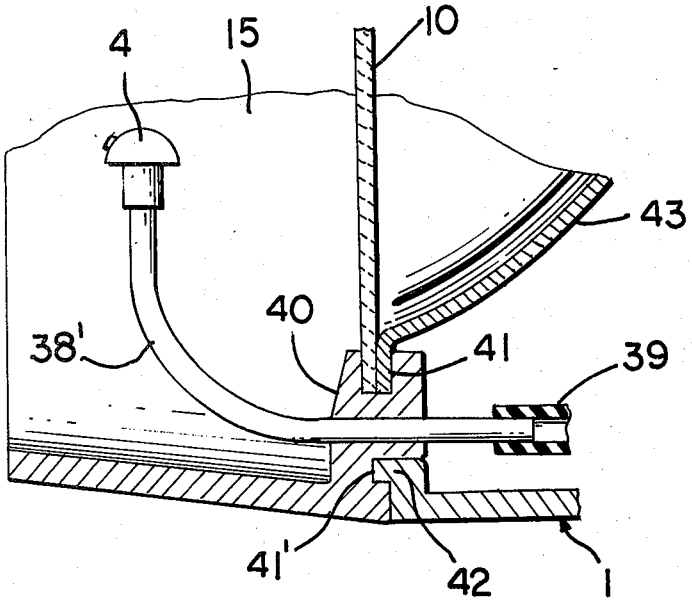
FIG. 10 is an enlarged partial section showing the mode of mounting a reflector and lens at the front extremity of the toy.

The components at the front extremity of the barrel of the device or toy constitute a subassembly as depicted in FIG. 10 and will now be described more in detail. The support or mounting 15 is preferably made of plastic like the barrel 1 and is tubular and tapered to complement the barrel. This support is provided with an annular formation 40 having an internal annular transverse groove 41 and an external annular groove 41' and the barrel is provided with a forwardly extending annular portion 42 which is secured in the groove 41' for holding the support to the barrel. It should be noted that the conduit section 38' extends through the annular formation 40 for support thereby. The light responsive means 10 and an annular flange of a reflector 43 is held in the annular groove 41 of the member 40 for holding these components assembled. The lamp 9 is carried by the reflector in a conventional manner. Responsive means 10 is preferably in the form of a round planar lens constructed of a suitable plastic or glass which is preferably of a red color whereby the light directed forwardly by the lamp and reflector will pass through the lens and impart or illuminate the stream of water substantially throughout its length and thereby simulate what may be termed a laser beam of light which promotes interest and fascination in the use of the toy. The diameter of the light beam and its cylindrical or tapered length are appreciable and the stream of ejected liquid extends axially therethrough.

Figure 6:
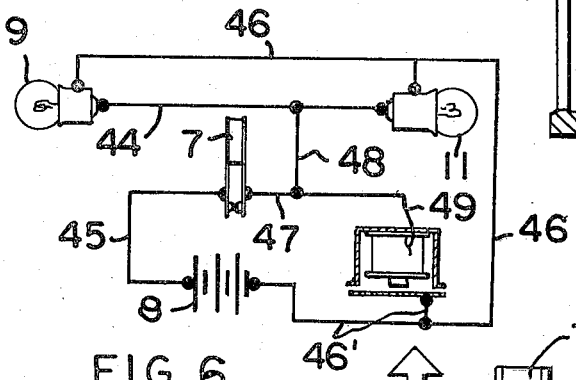
FIG. 6 is a diagram of the electrical circutry employed.

The electrical system as depicted in FIGS. 5 and 6 is comparatively simple and will now be described. The end terminals of lamps are connected by a common conductor 44 and the side terminals by a common conductor 46. A conductor 45 connects the terminal contact 33 of the switch means 7 with one of the batteries 8. A conductor 48 is connected to the conductor 44 and branch conductors 47 and 49 are respectively connected to the other terminal contact 34 and to the buzzer 13 and branch conductors 46' from conductor 46 are connected to the other battery and a vibrating member of the buzzer. The base terminals of the batteries are preferably connected by a bar as shown. The buzzer is preferably mounted at the underside of and substantially within the confines of the support or mounting 16 and this mounting is preferably perforated at 50 whereby to promote the noise factor. The buzzer is of a conventional character and is preferably provided with a manual control 13' for adjusting the volume of the noise. In view of the foregoing it will be apparent that the switch means 7 is interposed in electrical circuitry or conductor means whereby activation of the trigger 14 will effect illumination of the lamps and buzzer and operation of the valve means 6 to cause the liquid to be ejected through the nozzle 4 as is further described hereinafter.

The rear lamp 11 and certain of its associated components constituting a subassembly shown in FIG. 5 will now be described. This lamp is carried by a reflector 51 which has a flange fixedly secured in an internal annular groove 52 provided therefor in the support 16 and the light responsive means or lens 12 is provided with an external annular groove 53 which detachably receives an inturned flange 54 of the support. The support may be secured to the barrel 1 as shown in FIG. 5 or in the manner of support 15. The lens 12 is preferably snap connected to the support is somewhat thicker than the lens 10 and provided with a center opening 55 through which the piston rod reciprocates. This lamp, reflector and means 12 also serve to cause rays of colored light, preferably red, to emanate rearwardly concurrently with the rays emitted forwardly and into the stream of liquid through the agency of the front lamp 9, reflector 43 and lens 10 whereby to further promote or enhance fascination for the use of the toy.

Figure 9:
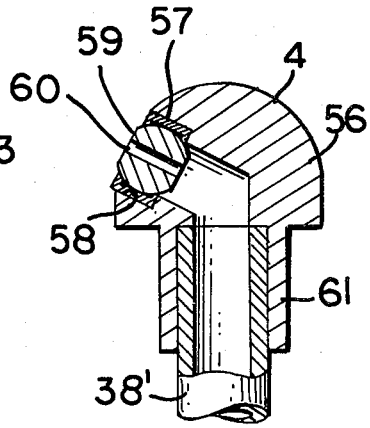
FIG. 9 is an enlarged vertical section of a nozzle assembly.

Referring now to the structure of the nozzle 4 best depicted in FIG. 9 of the drawing, the same is preferably constructed to form a hollow head 56 provided with a transverse seat 57 in which an annular resiliently flexible member 58 is disposed for rotatably supporting a manually adjustable element 59 having a diametrical passage or orifice 60 extending therethrough through which the liquid is forcibly ejected from the tank. The member 58 constitutes a double seal for the valve. The nozzle can be readily adjusted by inserting an instrument into the passage 60 and turning the element to any one of an infinite number of positions for directing the stream where desired. The nozzle head is preferably constructed from a suitable plastic material and includes a tubular portion 61 for receiving a fore end of the conduit 38' extending from the inverted tube 39, the latter constituting a coupling between the lengths or sections 38 and 38' of the conduit means. As stated above, the valve means 6 is interposed in the conduit means between the tank and nozzle.

With reference to the handle 5, it is preferably provided with a detachable cover 62 whereby to promote ready access to the interior of the handle in order to facilitate replenishment of batteries and/or adjustment or repair of the valve assembly and switch when required. The valve of the nozzle, as alluded to above, is such that the stream of water may be adjusted to vary its direction at any angle desired and the stream can be illuminated throughout at least the major portion of its length irrespective of its angle of direction. The organization is preferably such that when the stream diminishes more or less into a mist of a length in the neighborhood of 3', it denotes or indicates that the air pressure in the tank is down or that the water in the tank is being depleted.

Figure 11:
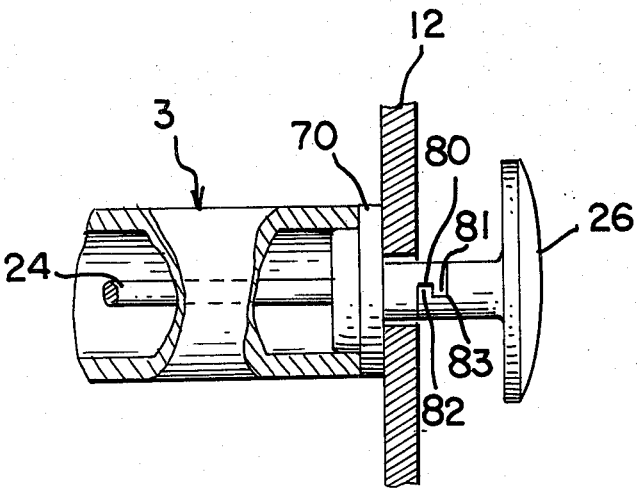
FIG. 11 is an enlarged partial section depicting a mode of detachably locking a piston rod of the pump in a forward inoperative position.

Provision is made to promote safety with respect to the pump and this is preferably accomplished, as shown in FIG. 11, by providing the bearing 70 with a notch 80 and projection 81 which serve to respectively mate with a projection 82 and notch 83 provided on the handle 26 for locking the piston rod in a forward inoperative position so that its rear extremity will not extend rearwardly to cause inadvertent injury to an operator handling the toy. Locking and unlocking of the rod is readily achieved by merely grasping the handle and rotating it clockwise or counter-clockwise relative to the fixed bearing 70.

Figure 12:
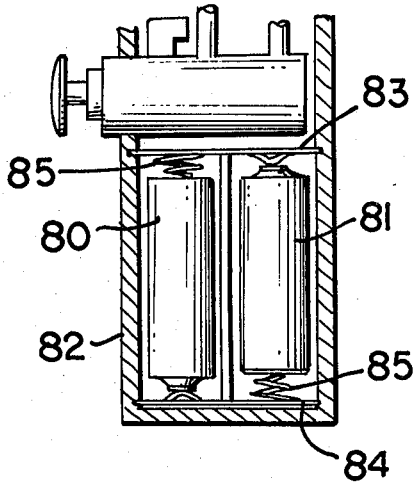
FIG. 12 is an enlarged sectional view showing a modified arrangement of batteries constituting the electrical source of energy.

The invention also contemplates an arrangement as depicted in FIG. 12 for a pair of batteries 80 and 81 in a handle 82. More specifically, the setup includes having the upper base and end terminals of these batteries engage an upper fixed bar 83 and the lower base and end terminals engage a bottom fixed bar 84, the base terminals being pressed by helical springs 85 to insure reliable contacting surfaces. Conductors, not shown, operatively connect batteries with the lamps and buzzer.

In view of the foregoing, it should be manifest that the operation of the toy is relatively simple and accomplished by merely activating the trigger 14. If the water in the tank 2 has been pressurized suffficiently by repeated operation of the pump 3 and the batteries or source of electrical energy are charged, pressing of the trigger will simultaneously cause the water to be expelled through the nozzle 4, effect illumination of the light responsive means at opposite extremities of the toy and operation of the buzzer. The trigger may be activated repeatedly to eject or squirt streams or jets of liquid until the supply of liquid in the tank is exhausted. If, for example, the supply of water is depleted, actuation of the trigger will simultaneously produce colored lights at the opposite extremities and operation of the buzzer so that the toy can be utilized solely for these particular purposes and conversely if the electrical system becomes inoperative, the toy can still be operated to eject a liquid.

It is to be understood that the invention or inventions as disclosed herein contemplate their utilization in a toy rifle, and that any liquid, such as clear or colored water, or chemical compositions may be employed. It is to be further understood that the illuminating means may comprise a lens, reflector and lamp, the reflector and lamp or the latter. It is also to be understood that the components of the toy are preferably designed and constructed whereby to facilitate assembly and disassembly thereof.

The toy or device has been tested and proven to be safe, efficient in operation and particularly conducive to the amusement of those concerned with its use.

Having thus described my invention or inventions, it is obvious that various modifications or additions to those described may be made in the same without departing from the spirit of the invention and, therefore, I do not wish to be understood as limiting myself to the exact forms, constructions, arrangements, and combinations of the components herein shown and described.

I claim:

1. A toy comprising an elongated housing having a chamber therein for a liquid, a pump including a piston having an exposed rod end extending rearwardly of said toy facilitating manual operation for building up an appreciable amount of pressure in said chamber for ejecting a stream of liquid therefrom an appreciable distance substantially forwardly of said toy, and means for controlling the ejection.

2. The toy defined in claim 1, including means whereby said stream may be illuminated throughout at least the major portion of its length.

3. The toy defined in claim 1, including noise producing means operable by said controlling means.

4. The toy defined in claim 1, including illuminating means operable by said controlling means for illuminating an area in a direction opposite to that of the stream.

5. In combination: an elongated housing having a front end and a rear end, a tank for a liquid disposed in said housing, a pump disposed in said tank and having a piston rod extending rearwardly from said rear end for manual operation to build up an appreciable amount of pressure in said tank, conduit means connected to said tank and having an outlet located at said front end whereby the liquid can be ejected in a stream an appreciable distance therefrom, valve means interposed in said conduit means for controlling the flow of liquid from said tank to said outlet, and means for operating said valve means.

6. In combination: an elongated housing having a front end and a rear end, a tank for a liquid disposed in said housing, a pump disposed in said tank and having a piston rod extending rearwardly from said rear end for manual operation to build up an appreciable amount of pressure in said tank, conduit means connected to said tank and having an outlet located at said front end whereby the liquid can be ejected in a stream an appreciable distance therefrom, valve means interposed in said conduit means for controlling the flow of liquid from said tank to said outlet, means for operating said valve means, and means arranged at said front end for connection with a source of electricity adapted for disposition in said housing for illuminating the stream throughout and about at least the major portion of its length.

7. A toy for ejecting a liquid, said toy comprising wall structure forming an elongated housing having a front end, a rear end, an internal chamber for containing a liquid and a hollow handle for containing a source of electricity, conduit means connected to said chamber and having an outlet at said front end, means for pumping air into said chamber for forcing a stream of liquid through said conduit means for ejection through its outlet forwardly of said front end, valve means disposed in said handle and interposed in said conduit means for controlling the flow of liquid therethrough, means at said front end including a lamp for illuminating the ejected stream throughout at least a major portion of its length, conductor means for connecting said lamp to a source, a switch disposed in said handle and interposed in said conductor means for controlling the operation of said lamp, and a trigger connected to said handle for simultaneously controlling the operation of said valve means and said switch.

8. The toy defined in claim 7, in which the direction of the ejected stream may be varied within a range from three feet to at least thirty feet.

9. A toy comprising wall structure forming an elongated housing, a chamber and a compartment, said housing having a front and a rear end, a reflector, lamp, and a nozzle located at said front end, conduit means for communicatively connecting said chamber and said nozzle, a pump for applying pressure against a liquid in the chamber, valve means interposed in said conduit means for controlling the flow of a liquid under pressure from said chamber to said nozzle, said compartment serving to contain a source of electricity, conductor means for connecting said lamp to a source, a switch interposed in said conductor means for controlling the flow of electricity to said lamp, and a trigger for operating said valve means and said switch whereby a stream of liquid can be ejected an appreciable distance substantially forwardly from said front end and illuminated throughout at least the major portion of its length.

10. A toy simulating a pistol comprising wall structure forming an elongated barrel of appreciable cross-section dimensions, a tank in the barrel for a liquid and a hollow handle, a cylinder disposed axially in said tank and provided with a check valve, a piston mounted in said cylinder for manual reciprocation for pumping air into said tank, conduit means connected to said tank and having an outlet located at the front of said barrel, valve means interposed in said conduit means, and a trigger operable independently of said piston carried by said handle for operating said valve means for controlling the forced flow of liquid through said outlet.

11. The toy defined in claim 10, including a nozzle connected to said outlet for adjusting the direction of the liquid expelled therefrom.

12. A toy water pistol comprising wall structure forming a barrel and a chamber therein extending throughout the major portion of its length for containing water and a hollow handle, said barrel having a rear extremity provided with a center opening and a front extremity, a cylinder extending axially in said chamber and provided with a check valve for preventing back flow of air from said chamber into said cylinder, a piston disposed in said cylinder and having a rod extending therefrom and through said opening for manipulation for pumping air into said chamber, a nozzle located adjacent to said front extremity, conduit means for communicatively connecting said chamber and said nozzle, valve means disposed in said handle for controlling the flow of water through said conduit means to said nozzle, and a trigger carried by said handle for controlling the operation of said valve means.

13. The toy defined in claim 12, including a lamp and a reflector therefor located adjacent to said nozzle, conductors for connecting said lamp with a source of electricity, and a switch operable by said trigger for controlling the flow of electricity to said lamp.

14. The toy defined in claim 12, including a lamp and light responsive means located adjacent to said nozzle, a switch carried by said handle, conductors for connecting said lamp and switch with a source of electricity, and said trigger also serves to control the operation of said switch so that when said lamp is energized said responsive means will be illuminated to impart a glow to the water ejected through said nozzle.

15. The toy defined in claim 12 including a lamp and a reflector therefor located at said rear extremity, conductors for connecting this lamp with a source of electricity, and a switch for controlling the flow of electricity through said conductors to said lamp.

16. A toy water pistol having a front extremity and a rear extremity and an elongated tank for water, a cylinder disposed substantially axially in said tank, a plunger having an inner end disposed in said cylinder and an outer end extending rearwardly through said rear extremity for manual reciprocation to compress air against the water in said tank, a nozzle at said front extremity, conduit means connecting the interior of said tank with said nozzle, valve means interposed in said conduit means, and a trigger for operating said valve means for controlling the flow of any water in said tank through said nozzle via said conduit means.

17. A toy comprising wall structure forming an elongated housing having a chamber therein for a liquid and a compartment for a source of electricity, means for building up an appreciable amount of pressure in said chamber, a nozzle located at the front of said housing, conduit means for connecting said chamber and said nozzle, valve means interposed in said conduit means for controlling the flow of a liquid therethrough, a lamp disposed at said front, a reflector for said lamp, a colored lens disposed in front of said reflector, conductor means for connecting a source with said lamp, a switch interposed in said conductor means for controlling the operation of said lamp, and means for operating said valve means and said switch whereby a stream of liquid ejected through said nozzle will be illuminated throughout the major portion of its length.

18. The toy defined in claim 17, including a lamp, reflector and a colored lens located at the rear of said housing, conductor means for connecting this lamp to said switch and a source for illuminating an area at said rear when said switch is operated.

19. The toy defined in claim 17, including a buzzer located at the rear of said housing, conductor means for connecting said buzzer to said switch and a source for producing a noise when said switch is operated.

20. A toy comprising an elongated housing have a chamber therein for a liquid and a compartment for a source of electricity, means for pumping and maintaining an appreciable amount of air pressure in said chamber, a nozzle at the front of said housing, conduit means for connecting said chamber and said nozzle, valve means interposed in said conduit means, a lamp and a reflector therefor located at said front and a rear of said housing, a colored lens disposed at each reflector, conductor means for connecting said lamps to a source, a switch interposed in said conductor means, and means for operating said valve means and said switch for expelling a stream of liquid from said nozzle and illuminating the stream throughout the major portion of its length.

21. The toy defined in claim 20, including a buzzer located at said rear, conductor means for connecting said buzzer to said switch and a source for producing noise when said switch is operated.

22. The toy defined in claim 20, in which said nozzle comprises a hollow body, a tubular resilient member secured in said body and provided with an internal annular seat, and an element adjustable in said seat provided with an orifice through which the liquid flows.

23. A toy having a barrel and an offset handle, said barrel having a front extremity and a rear extremity, a colored lens and a lamp carried by said front extremity, a switch carried by said handle, conductor means for connecting said lamp and switch with a source of electricity, a trigger carried by said handle for controlling the operation of said switch to cause said lamp to illuminate said lens, and a nozzle located in front of said lamp through which a liquid can be projected forwardly from said front extremity.

24. The toy defined in claim 23, including a buzzer carried by said rear extremity, and conductor means for connecting said buzzer and said switch whereby said trigger will also control the operation of said buzzer.

25. The toy defined in claim 23, including a second lamp and a second colored lens carried by said rear extremity, conductor means for connecting said second lamp to said switch whereby manipulation of said switch will also control operation of said second lamp to illuminate said second lens.

26. A toy simulating a pistol comprising wall structure forming an elongated barrel of appreciable cross-dimension having a front extremity, a rear extremity and an offset compartment located intermediate these extremities for housing a source of electricity, a lens, a lamp and a reflector therefor carried by said rear extremity, conductor means for connecting said lamp to a source, a switch interposed in said conductor means, and a manual control carried by said compartment for controlling said switch whereby said lamp may be energized to illuminate said lens so that it is visible a remote distance from said rear extremity.

27. The toy defined in claim 26, in which said front extremity is provided with a second lens, a second lamp and reflector therefor, conductor means for connecting said second lamp to a source, and said control also serves to control the energization of said second lamp to illuminate said second lens.

28. An assembly for use in a toy water gun, said assembly comprising an elongated casing having an inlet for a liquid and an outlet therefor, an abutment disposed in said casing between said inlet and outlet and provided with an opening, a shaft reciprocably mounted in said casing and extending through said opening, a valve carried by said shaft and disposed between said abutment and said inlet, means for biasing said valve against said abutment for normally closing said opening, and said shaft being operable to disengage said valve from said abutment whereby liquid entering said inlet may be caused to flow through said outlet via said opening.

29. The assembly defined in claim 28, including a switch, and means connected to said shaft and extending therefrom for operating said switch.

30. A toy water pistol comprising wall structure forming a barrel and a chamber therein extending throughout the major portion of its length for containing water and a hollow handle, said barrel having a rear extremity provided with a center opening and a front extremity, a cylinder extending axially in said chamber and provided with a check valve for preventing back flow of air from said chamber into said cylinder, a piston disposed in said cylinder and having a rod extending therefrom and through said opening for manipulation for pumping air into said chamber, a nozzle located adjacent to said front extremity, conduit means for communicatively connecting said chamber and said nozzle, valve means disposed in said handle for controlling the flow of water through said conduit means to said nozzle, a lamp and a reflector therefor located adjacent to said nozzle, conductors for connecting said lamp with a source of electricity, a switch for controlling the flow of electricity to said lamp, and a trigger carried by said handle for controlling the operation of said valve means and said switch.

31. A toy water pistol comprising wall structure forming a barrel and a chamber therein extending throughout the major portion of its length for containing water and a hollow handle, said barrel having a rear extremity provided with a center opening and a front extremity, a cylinder extending axially in said chamber and provided with a check valve for preventing back flow of air from said chamber into said cylinder, a piston disposed in said cylinder and having a rod extending therefrom and through said opening for manipulation for pumping air into said chamber, a nozzle located adjacent to said front extremity, conduit means for communicatively connecting said chamber and said nozzle, valve means disposed in said handle for controlling the flow of water through said conduit means to said nozzle, a lamp and light responsive means located adjacent to said nozzle, a switch carried by said handle, conductors connecting said lamp and switch with a source of electricity, and a trigger carried by said handle for controlling the operation of said valve means and said switch so that when said lamp is energized said responsive means will be illuminated to import a glow to the water ejected through said nozzle.

32. A toy comprising an elongated housing have a chamber therein for a liquid and a compartment for a source of electricity, means for pumping and maintaining an appreciable amount of air pressure in said chamber, a nozzle at the front of said housing, conduit means for connecting said chamber and said nozzle, valve means interposed in said conduit means, a lamp and a reflector therefor located at said front and a rear of said housing, a buzzer located at said rear, a colored lens disposed at each reflector, conductor means for connecting said lamps and buzzer to a source, a switch interposed in said conductor means, and means for operating said valve means and said switch for expelling a stream of liquid from said nozzle and illuminating the stream throughout the major portion of its length and causing said buzzer to produce noise.

33. A toy comprising an elongated housing having a chamber therein for a liquid and a compartment for a source of electricity, means for pumping and maintaining an appreciable amount of air pressure in said chamber, a nozzle at the front of said housing constructed to provide a hollow body, a tubular resilient member secured in said body and provided with an internal annular seat, an element adjustable in said seat provided with an orifice, conduit means for connecting said chamber and said nozzle, a valve interposed in said conduit means, a lamp and a reflector therefor located at said front and a rear of said housing, a colored lens disposed at each reflector, conductor means for connecting said lamps to a source, a switch interposed in said conductor means, and means for operating said valve means and said switch for expelling a stream of liquid from said orifice and illuminating the stream throughout the major portion of its length.

34. A toy having a barrel and an offset handle, said barrel having a front extremity and a rear extremity, a colored lens and a lamp carried by each of said extremities, a switch carried by said handle, conductor means for connecting said lamps and switch with a source of electricity, and a trigger carried by said handle for controlling the operation of said lamps to illuminate said lenses so they are respectively visible remote distances from said extremities.

35. A toy simulating a pistol comprising wall structure forming an elongated barrel of appreciable cross-dimension having a front extremity, a rear extremity and an offset compartment located intermediate these extremities for housing a source of electricity, a lens, lamp and a reflector therefor carried by each of said extremities, conductor means for connecting said lamps to a source, a switch interposed in said conductor means, and a manual control carried by said compartment for controlling said switch whereby said lamps can be energized to illuminate said lens so they are respectively visible remote distances from said extremities.

* * * * *